US005130016A

United States Patent [19]

Gavin

[11] Patent Number: 5,130,016

[45] Date of Patent: Jul. 14, 1992

[54] DRAIN GRATE

[76] Inventor: Norman W. Gavin, 2545 Ridge Rd., North Haven, Conn. 06473

[21] Appl. No.: 646,114

[22] Filed: Jan. 28, 1991

[51] Int. Cl.[5] ..... E03F 5/06

[52] U.S. Cl. ..... 210/164; 404/4

[58] Field of Search ..... 210/163, 164; 404/2, 404/3, 4, 5; 137/356, 363

[56] References Cited

U.S. PATENT DOCUMENTS

| | | | |
|---|---|---|---|
| 2,615,526 | 10/1952 | Lane | 210/164 |
| 2,689,017 | 9/1954 | Schmid | 210/164 |
| 2,889,928 | 6/1959 | Sisk | 210/164 |
| 4,030,851 | 6/1977 | Graybeal | 210/163 |
| 4,300,721 | 11/1981 | Rich | 238/2 |
| 4,345,998 | 8/1982 | Graffis et al. | 210/164 |
| 4,367,142 | 1/1983 | Blecher | 210/163 |
| 4,910,811 | 3/1990 | Izzi, Sr. | 4/292 |

FOREIGN PATENT DOCUMENTS

| | | | |
|---|---|---|---|
| 2209782 | 5/1989 | United Kingdom | 404/4 |

*Primary Examiner*—Peter A. Hruskoci
*Assistant Examiner*—Robert James Popovics
*Attorney, Agent, or Firm*—Robert A. Seemann

[57] ABSTRACT

A first wall with a plurality of openings to pass liquid and particulate matter, includes four arrangements of ribs on the back. The ribs are spaced from the openings to reduce surface contact with the liquid and particulate matter. The ribs of the first and second arrangements are of uniform height and intersect to form open ended boxes. The ribs of the third and fourth arrangements extend from ribs of the first and second arrangements respectively, each extended rib curving down from each side of a high point, to the rib from which it extends.

11 Claims, 3 Drawing Sheets

DRAIN GRATE

BACKGROUND OF THE INVENTION

1. Field of the Invention

The present invention relates to liquid separation, more specifically to a grated inlet surface drain which includes clog resistant reinforcement for passing liquids contaminated with particulate and chemical waste that would normally cling to and block a drain grate of common design. The present drain grate is designed to support unusually large loads while providing the above characteristics, and be easily removable from a drain frame with simple hand tools.

2. Description of the Prior Art

The typical drain grate is designed to support traffic loads ranging from pedestrian traffic to heavy wheeled vehicles. It is usually made from cast iron or steel, for strength, although one of a small surface area may be made from plastic, and rests in a recessed frame in the ground. It is held in place by friction, but is occasionally screwed down to the frame.

The frame comprises the top portion of a drain box which is set into the ground. The drain box is connected to a sewer pipe.

The grate comprises a wall that is thick enough to bear the weight of traffic. The wall includes openings for passing liquids therethrough from the top into the drain box.

One floor drain grate is described in U.S. Pat. No. 4,910,811 patented Mar. 27, 1990 by L. B. Izzi, Sr. The assembly is designed for use in a factory floor where corrosive liquids are likely to enter a drain and damage a metal drain assembly.

The assembly includes a bowl-shaped connector body, and a strainer plate, each of which is molded from a rigid plastic material.

The strainer plate comprises a load bearing wall of uniform thickness, defining a plurality of round holes through the wall in a direction normal to the plane of the wall. The plate has a lower surface that is received on an annular seat within the rim of the connector body.

A plurality of positioning pins extend normally from the lower surface of the plate. The positioning pins are received in interference fit within in a series of circumferentially spaced positioning apertures in the top of the seat.

The plate fits within a recess in the rim so that the top of the plate is substantially flat with the surface of the floor when the connector body is installed in the floor.

U.S. Pat. No. 4,345,998 patented Aug. 24, 1982 by Graffis et al. discloses a plastic drain grate for a plastic catch basin in which the drain grate comprises a load bearing wall of uniform thickness having an inverted channel around the periphery for rigidity and for nesting snugly and optionally with a friction fit within the frame of the catch basin. The wall comprises a rectangular grid of square apertures directed through the wall normally to the plane of the wall.

A system for collecting liquid spillage at rail facilities, described in U.S. Pat. No. 4,300,721, patented by B. Rich on Nov. 17, 1981, includes collector pans which rest across the railroad ties. Each pan connects into a drain pipe which runs between the ties.

The pan comprises a plate of uniform thickness that is formed with a shallow depression for draining liquids toward a hole through the plate. The top of the plate includes a molded non-skid thread.

The bottom of the plate included intersecting longitudinal and transverse reinforcing ribs which terminate short of the edge margins of the plate where they taper down to meet the plate.

The inner wall of the hole extends below the plate via a nipple which is integrally molded within one of the ribs.

SUMMARY OF THE INVENTION

It is one object of the invention to provide a reinforced drain grate in which the reinforcement does not contribute to clogging from particulate matter.

It is another object of the invention to provide a plastic drain grate that is highly reinforced against traffic loading at a relatively low cost.

It is yet another object to provide a drain grate that seats firmly in a drain frame without binding against removal.

Another object is to provide a drain grate with the above reinforcement that stacks for shipment.

Other objects and advantages will become apparent from the ensuing description of the invention.

In accordance with the invention, a drain grate includes a first wall for receiving the weight of traffic, the wall having a front side and a back side.

A plurality of openings through the wall permit waste liquid and appropriately small particulate matter to pass through the wall from the front side to the back of the drain grate.

A first arrangement of parallel ribs extend normally from the back side of the wall. A second arrangement of parallel ribs, about the same height as the first set, extend normally from the back side of the wall, intersecting the ribs of the first arrangement so that they form a plurality of backward-open-ended boxes.

Each of a plurality of the boxes includes one of said openings with the perimeter of the enclosed opening spaced from the ribs with some of the first wall surrounding the enclosed opening between its perimeter and the ribs.

In a third arrangement of ribs, each rib is a backward extending continuation of one of the ribs of the first arrangement, and curves down from each side of a high point to the top of the rib from which its extends, ending short of the ends of that rib.

In a fourth arrangement of ribs, each rib is a backward extending continuation of one of the ribs of the second arrangement, and curves down from each side of a high point to the top of the rib from which it extends, ending short of the ends of that rib.

Ribs of the third and fourth arrangement intersect, with each of a plurality of ribs of the third arrangement intersecting a rib of the fourth arrangement with their high points on the curve of the fourth arrangement rib at the point of intersection.

The ribs are spaced from the openings so that particulate matter which passes through the openings will tend to fall clear of the ribs, for reducing clogging of the grate by adhesion of particulate matter to elements on the back side of the grate.

BRIEF DESCRIPTION OF THE DRAWINGS

In order that the invention will be more fully comprehended, it will now be described, by way of example, with reference to the accompanying drawings, in which.

DESCRIPTION OF THE PREFERRED EMBODIMENTS

Figure 1:
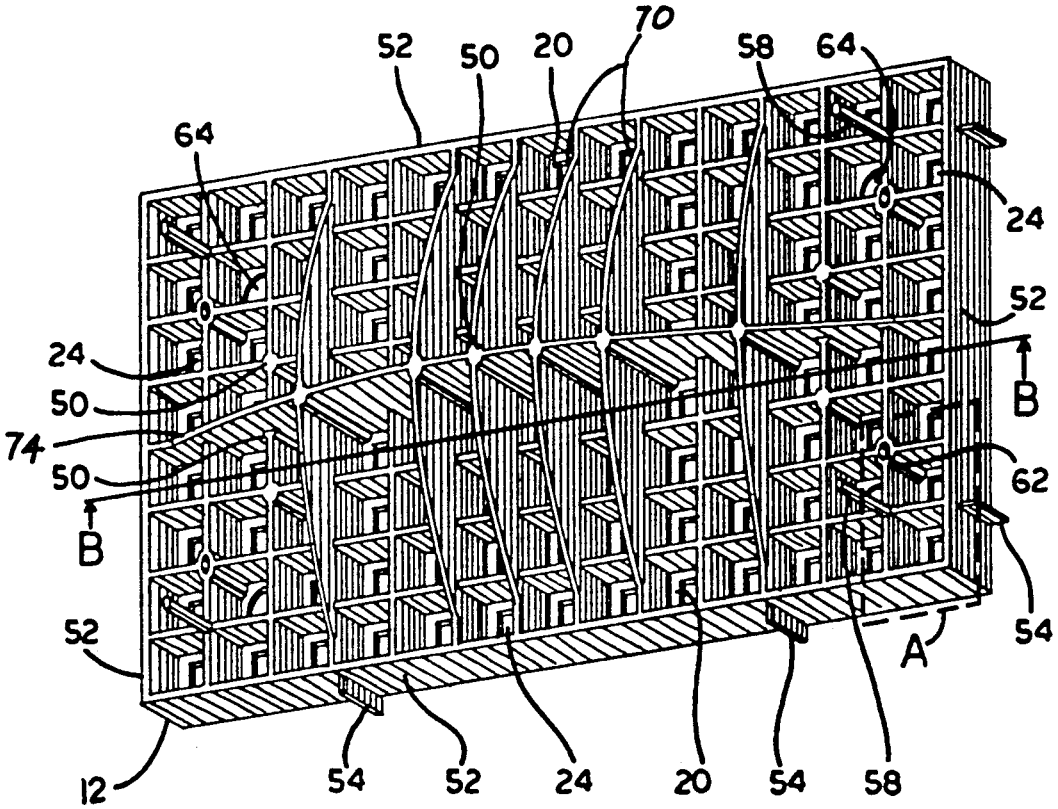
FIG. 1 is a perspective bottom view of a drain grate manufactured according to the present invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Drain grate 12 shown in FIGS. 1-4 is preferably molded from a material that resists adhesion of dirt and that will not form rust which catches dirt. One such material, for example, is glass filled polypropylene.

Figure 2:
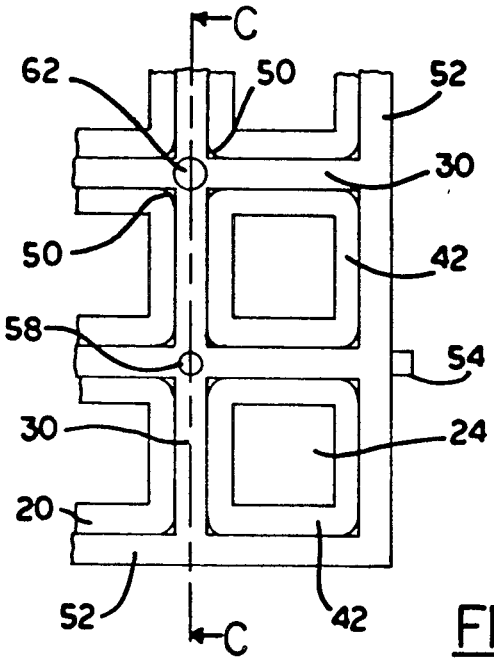
FIG. 2 is a schematic top bottom view of a representatiive portion marked "A" of the grate shown in FIG. 1, in which additional reinforcement is shown.
Figure 3:
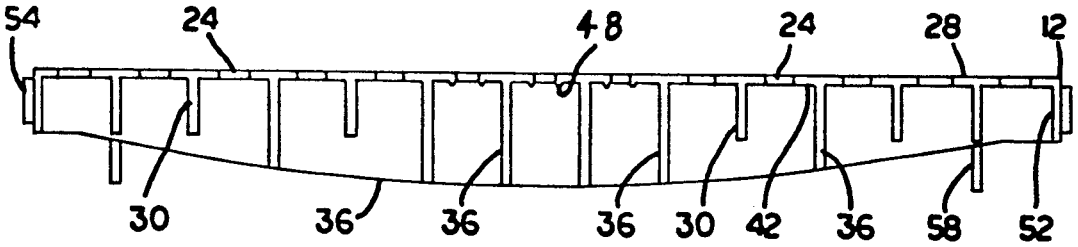
FIG. 3 is an inverted cross section view taken along the lines B—B of the grate shown in FIG. 1.

Referring to FIGS. 1, 2, and 3, top wall 20 of drain grate 12 is of uniform thickness and includes screen openings 24. Top surface 28 which receives the weight of traffic, receives liquid and particulate matter for disposal. Openings 24 permit the liquid and particulate matter small enough to fit through them to fall through from top surface 28.

Load bearing strength for wall 20 is provided by straight ribs 30 and curved ribs 36. Ribs 30 and 36 permit wall 20 to be of minimum necessary thickness to provide the screen and transfer load to the ribs.

This reduces material cost in manufacture, and reduces the chance of clogging of the drain grate.

The resulting shorter wall length of each opening 24 reduces clogging of the hole by cocking of larger particulate matter against the wall, and reduces the available surface area for clogging of the holes by adhesion of larger bits of particulate matter to the hole wall.

Ribs 30 and 36 are spaced from the holes to avoid retarding flow by contact with moistened particulate matter which will fall parallel to and spaced from the ribs.

Although particulate matter tends to fall clear of the ribs, it is possible in some instances for the liquid to flow over the surfaces of shoulder 42 and walls of ribs 30 and 36. This tendency can be reduced by shaping the edge break of the hole, for example, by adding a small downward facing ridge 48 as shown at one of the holes in FIG. 3.

Ribs 30 are preferably of the same height and run across wall 20 in two directions, intersecting one another.

Figure 4:
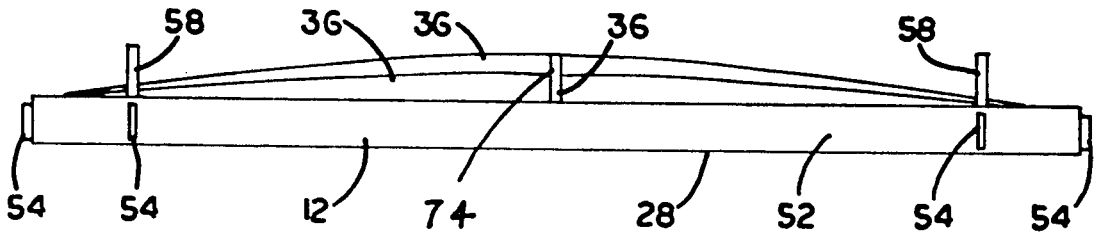
FIG. 4 is a right side view of the drain grate shown in FIG. 1.

Curved ribs 36 preferably vary in height as shown in FIGS. 1, 3, and 4, each reaching some height that is greater than that of ribs 30. The curved ribs are in two intersecting arrangements as shown in FIGS. 1 and 4, arrangements 70 and 74.

As shown in FIG. 1, arrangement 70 has six parallel ribs of varying height, each rib curving down from each side of a high point to the top of the straight rib from which is extends. Arrangement 74 has a single rib which also curves down from each side of a high point to the top of the straight rib from which it extends. Each of the ribs of arrangement 70 intersects the rib of arrangement 74 along its curves. Preferably, for at least one rib of arrangement 74, the high points of the 70 arrangement's intersecting ribs are located on the curve of that at least one rib.

Additional resistance against bending and twisting of the drain grate is provided by thickened sections 50 of selected ribs where they join at their intersection as shown in FIGS. 1 and 2.

Peripheral wall 52 is perferably the same height as that of ribs 30. Protuberances 54 shown in the form of friction ribs provide non-binding gripping means for removably holding the drain grate in a typical drain frame (not shown).

Figure 5:
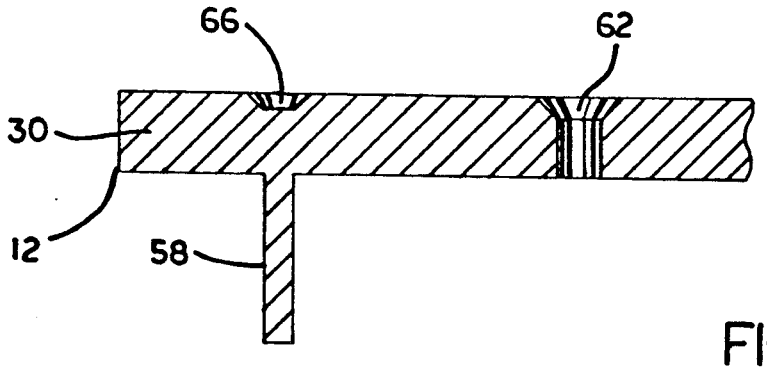
FIG. 5 is a cross section view taken along the lines C—C of the portion of the grate shown in FIG. 2.

Referring to FIG. 5, stacking pins 58 fit in recesses 66 which are appropriately located in top surface 28 so that a number of drain grates can be stacked for shipment or storage.

Bolt holes 62 and 64 are provided for receiving a long screw for optionally bolting the drain grate to the bottom of a drain box.

Although the invention has been described in terms of specific preferred embodiments, it will be obvious to one skilled in the art that various modifications and substitutions are contemplated by the invention disclosed herein and that all such modifications and substitutions are included within the scope of the invention as defined in the appended claims.

I claim:

1. A drain grate comprising:

a first wall for receiving the weight of traffic, said first wall including a front side and a back side, and defining a plurality of openings therethrough for receiving waste including liquid and particulate matter at said front side for passage of said waste through said drain grate, a first arrangement of ribs for strengthening the grate against the weight of traffic, said ribs of said first arrangement being parallel and extending normally from the back side of said first wall, a second arrangement of ribs for strengthening the grate against the weight of traffic, said ribs of said second arrangement being parallel and extending normally from the back side of said first wall, the ribs of said first arrangement intersecting the ribs of said second arrangement so that together they form a plurality of backward-open-ended boxes, each of a plurality of said boxes, including one of said openings with the perimeter of said enclosed opening spaced from the ribs with some of said first wall surrounding the enclosed opening between its perimeter and the ribs, so that although liquid may flowingly cling to the back side and ribs, particulate matter will tend to fall clear of the ribs, for reducing clogging of the grate by adhesion of particulate matter to elements on the back side of the grate.

2. The drain grate described in claim 1, further comprising:

the ribs of said first arrangement being of approximately the same height as the ribs of said second arrangement.

3. The drain grate described in claim 2, further comprising:

each of the ribs of said first arrangement being of approximately the same height, and each of the ribs of said second arrangement being of approximately the same height.

4. The drain grate described in claim 3, further comprising:

each of the ribs of said first and second arrangements being of constant thickness.

5. The drain grate described in claim 2, further comprising:

a third arrangement of ribs, each of the ribs of said third arrangement being a backward extending continuation of one of the ribs of said first arrangement, curving down from each side of a high point to the top of the rib from which it extends, said curves ending short of the ends of the rib from which it extends.

6. The drain grate described in claim 5, further comprising:

a fourth arrangement of ribs, each of the ribs of said fourth arrangement being a backward extending continuation of one of the ribs of said second arrangement, curving down from each side of a high point to the top of the rib from which it extends, said curves ending short of the ends of the rib from which it extends, each of a plurality of ribs of said third arrangement, intersecting a rib of said fourth arrangement along its curves.

7. The drain grate described in claim 5, further comprising:

the high points of said third arrangement's intersecting ribs located on the curve of said fourth arrangement's intersected rib at the point of intersection.

8. The drain grate, described in claim 2, further comprising:

a second wall, attached to said first wall, and enclosing said first and second arrangement of ribs, attached to each rib in said first and second arrangement, and being the same height as the ribs of said first and second arrangements.

9. The drain grate described in claim 8, further comprising:

raised ridges, on said second wall for radially engaging the inner walls of a drain housing, each ridge oriented normal to the back side of said first wall, posts, attached to the back of the drain grate, said posts extending higher than the ribs of said fourth arrangement of ribs, for resting in receptacles for said posts on the front side of said first wall for stacking the drain grates, and receptacles on the front side of said first wall, for receiving said posts.

10. A drain grate comprising:

a first wall for receiving the weight of traffic, said first wall including a front side and a back side, and defining a plurality of openings therethrough for receiving waste including liquid and particulate matter at said front side for passage of said waste through said drain grate, a first arrangement of ribs for strengthening the grate against the weight of traffic, said ribs of said first arrangement being parallel and extending normally from the back side of said first wall, a second arrangement of ribs of strengthening the grate against the weight of traffic, said ribs of said second arrangement being parallel and extending normally from the back side of said first wall, said ribs of said first arrangement intersecting the ribs of said second arrangement so that together they form a plurality of backward-open-ended boxes, the ribs of said first arrangement being of approximately the same height as the ribs of said second arrangement, a third arrangement of ribs, each of the ribs of said third arrangement being a backward extending continuation of one of the ribs of said first arrangement, curving down from each side of a high point to the top of the rib from which it extends, said curves ending short of the ends of the rib from which it extends, a fourth arrangement of ribs, each of the ribs of said fourth arrangement being a backward extending continuation of one of the ribs of said second arrangement, curving down from each side of a high point to the top of the rib from which it extends, said curves ending short of the ends of the rib from which it extends, each of a plurality of ribs of said third arrangement, intersecting a rib of said fourth arrangement along its curves.

11. The drain grate described in claim 10, further comprising:

the high points of said third arrangement's intersecting ribs located on the curve of said fourth arrangement's intersected rib at the point of intersection.

* * * * *